US006477919B1

(12) United States Patent
Thomas et al.

(10) Patent No.: US 6,477,919 B1
(45) **Date of Patent: *Nov. 12, 2002**

(54) POWERED DECAPPING TOOL TO REMOVE A CAP FROM A BOTTLE OR VIAL

(75) Inventors: Glenn E. Thomas, Louisville, KY (US); Paul T. Scherer, Lexington, KY (US); Joseph L. Hallock, Lexington, KY (US); Edward B. Alcorn, Lexington, KY (US)

(73) Assignee: Chromatography Research Supplies, Inc., Louisville, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/575,389

(22) Filed: May 22, 2000

Related U.S. Application Data

(63) Continuation-in-part of application No. 09/243,301, filed on Feb. 2, 1999, now Pat. No. 6,076,330.

(51) Int. Cl.[7] ..... B67B 7/00
(52) U.S. Cl. ..... 81/3.2
(58) Field of Search ..... 81/3.07, 3.2

(56) References Cited

U.S. PATENT DOCUMENTS

| | | | | |
|---|---|---|---|---|
| 2,415,896 A | | 2/1947 | Marsh et al. | |
| 2,732,741 A | * | 1/1956 | Muller-Strobel | 81/3.2 |
| 3,217,519 A | | 11/1965 | Demler | |
| 3,332,211 A | | 7/1967 | Koll et al. | |
| 3,747,441 A | | 7/1973 | Amtsberg et al. | |
| 3,771,284 A | | 11/1973 | Boeckmann et al. | |
| 3,998,032 A | | 12/1976 | Koebbeman | |
| 4,265,071 A | * | 5/1981 | Smith et al. | 81/3.2 |
| 4,358,970 A | * | 11/1982 | Jacobson | 81/3.2 |
| 4,745,729 A | | 5/1988 | Bethge et al. | |
| 4,952,412 A | | 8/1990 | Baxter et al. | |
| 4,987,722 A | | 1/1991 | Koebbeman | |
| 5,327,697 A | | 7/1994 | Kent | |
| 5,579,626 A | | 12/1996 | Thomas | |
| 5,778,740 A | * | 7/1998 | Tye | 81/3.2 |

FOREIGN PATENT DOCUMENTS

| | | |
|---|---|---|
| DE | 1010400 | 6/1957 |

* cited by examiner

*Primary Examiner*—Eileen P. Morgan
*Assistant Examiner*—Joni B. Danganan
(74) *Attorney, Agent, or Firm*—James C. Eaves, Jr.; Karen L. Lynd; Greenebaum Doll & McDonald PLLC

(57) ABSTRACT

The present invention relates to a powered decapping tool used to remove a cap from a bottle or vial. The powered tool has a vertical housing portion which the user holds to activate the decapping action. The decapping action results form a motor causing a plunger to move downward, thereby initially closing a plurality of jaws and continuing downward to cooperate with the jaws to remove the cap from the bottle or vial. Means may be provided to adjust the starting point of the decapping cycle or the plunger upper limit as well as the finishing point of the decapping cycle or the plunger lower limit.

20 Claims, 15 Drawing Sheets

POWERED DECAPPING TOOL TO REMOVE A CAP FROM A BOTTLE OR VIAL

This application is a continuation-in-part of application Ser. No. 09/243,301, filed Feb. 2, 1999, now U.S. Pat. No. 6,076,330 for a powered crimping tool to secure a cap onto a bottle or vial, incorporated herein by reference.

BACKGROUND OF THE INVENTION (a) Field of the Invention

The present invention relates to a powered decapping tool used to remove a cap from a bottle or vial. In the parent application, referenced above, the tool, having a plurality of crimping jaws, is used to secure a cap onto a bottle or vial. In contrast, in this application, an alternative plunger and jaws are employed to permit removal of the cap previously crimped onto the bottle or vial. The powered tool has a housing portion which the user holds and includes switches for the user to control the decapping action. The decapping action results from a motor causing a plunger to move downward, thereby initially closing a plurality of jaws and continuing downward to cooperate with the jaws to remove the cap from the bottle or vial.

(b) Description of the Prior Art

Some bottles or vials to contain liquid samples or other laboratory materials have an opening thereinto which includes a lip onto which a cap is crimped to seal the bottle or vial. In general, for example, the cap can be aluminum or steel, with sample diameters of from about 8 mm to about 22 mm, or greater. Typically the cap has a cylindrical portion which fits over the bottle lip and is then crimped thereunder; the cap has a top with a circular opening therein; the inside of the cap contains a rubber circular portion next to the cap and a Teflon circular portion next to the bottle, although many variations are known. In use, a sample is placed into the bottle or vial and a cap is placed thereon. A crimping tool is then employed to crimp the cap onto the bottle. When a portion of the sample is to be removed, a syringe is inserted through the rubber and Teflon circular portions and the desired amount of the sample is removed. U.S. Pat. No. 5,579,626, to Applicant Thomas, incorporated herein by reference, teaches a manually operated crimping tool for securing a cap onto a bottle or vial. That invention teaches the use of jaws 70 and a manually driven plunger 50 which have a similar vertically downward crimping movement to the instant invention without the adjustment means for the crimping cycle. That reference teaches horizontal handle movement resulting in vertical plunger movement.

U.S. Pat. No. 4,987,722, to Koebbeman, teaches a hand-held bottle cap crimper having a pair of horizontal crimping handles, one upper fixed handle and one lower lever handle which moves about a single pivot point to move a crimper, the pivot point being between jaws and the handles so that the tool functions in a see saw fashion.

U.S. Pat. No. 4,745,729 to Bethge et al., teaches a container closing apparatus used to put on a screw cap. U.S. Pat. No. 3,998,032, to Koebbeman, teaches a hand-held bottle cap crimper having a pair of horizontal crimping handles, one lower fixed handle and one upper lever handle which moves about a single pivot point to move a crimper, the jaws being between the pivot-point and the handles.

U.S. Pat. No. 3,332,211, to Koll et al., teaches a cap applying apparatus. U.S. Pat. No. 3,217,519, to Demler, teaches a coaxial crimping tool. U.S. Pat. No. 2,415,896, to Marsh et al., a cap applying implement.

U.S. Pat. No. 5,327,697, to Kent, teaches a chuck for a bottle capper. U.S. Pat. No. 3,771,284, to Boeckmann et al., teaches a capping apparatus. Finally, U.S. Pat. No. 3,747,441, to Amtsberg et al., teaches a pneumatic tool having combined nut running and crimping mechanism.

Manual decapping tools are also known for use in removing a cap from a bottle or vial.

SUMMARY OF THE INVENTION

The invention of the parent application relates to a powered crimping tool used to secure a cap onto a bottle or vial. The powered tool has a vertical housing portion which the user holds 5 while activating the crimping action. The crimping action results from a motor causing a plunger to move downward, thereby initially closing a plurality of jaws and continuing downward to cooperate with the jaws to secure the cap on the bottle or vial. Means are provided to adjust the starting point of the crimping cycle or the plunger upper limit, as well as the finishing point of the crimping cycle or the plunger lower limit.

More particularly, the invention of the parent application comprises a housing containing a battery-operated motor. A speed reduction system having a ratio of about 64 to 1 causes a plunger lead screw to rotate at a speed of about 1/64th the motor speed. The plunger lead screw has a threaded drive shaft which is threadably received within the plunger threaded drive channel. Rotation of the plunger lead screw threaded drive shaft results in vertical movement of the plunger, as limited by the plunger hex guide members vertical travel within the hex plunger channel in an insert. With the plunger toward its upper limit, the powered crimping tool is in an "jaws open" position, whereby a portion of the jaws fit into an hour glass shaped portion of the plunger to permit the jaws to be open. As the plunger moves downward, the jaws close and then, as the plunger continues downward, a cap is crimped onto a vial or bottle by the cooperation of the plunger and the jaws. Preferably, the jaws are retained about the plunger by a circular spring, band, or other confining means which tries to pull the jaws together toward their upper end, as limited by the plunger.

Both the upper and lower limits of the plunger can be adjusted. The total movement of plunger from the upper to lower limit and back to the upper limit is controlled. Further, once the plunger has moved through a pre-set vertical distance, the plunger will complete one crimping cycle without the user having to continue to engage a control. This frees the user to concentrate on the crimping operation.

Further, the invention of the parent application comprises a crimping tool, having a housing containing a motor therein; a plunger moveable by the motor between a start position and a start position; a plurality of jaws extending from the housing, each of the plurality of jaws having an upper opening portion and a lower crimping portion with an arcuate plunger slide area therebetween; the crimping portion having an inward crimping lip; the plurality of jaws and the plunger being in an abutting relationship; the jaws being in an open position when the plunger is at the start position and in a closed position when the plunger is at the stop position; and, means for electronically adjusting the stop position. The tool can also include optional means for electronically adjusting the start position.

Finally, the invention of the parent application is for a powered crimping tool, comprising: a housing containing a motor therein, the housing having a trigger switch, a rocker switch or alternatively two adjustment switches, and a reset switch; the housing containing a circuit board having a controller operably connected thereto, the trigger switch, the rocker switch or two adjustment switches, and the reset switch being operably connected to the controller; the motor includes a pulse disk on a motor powered shaft and where the tool includes a pulse sensor, the motor powered shaft being operably connected through a speed reduction system and a plunger lead screw to a plunger movable between the start position with a value of "x" counts and a stop position having a value of "y" counts; where, by operation of the trigger switch and the motor thereby, the controller will cause the motor powered shaft to rotate until the pulse sensor has detected a first selected number of pulses with a value of "y-x" counts from the pulse disk to move the piston from the start to the stop position, unless a stall condition is detected, and when the first selected number of pulses has been detected or the stall condition is detected, the motor powered shaft will rotate to return the piston to the start position; a plurality of jaws extending from the housing each of the plurality of jaws having an upper opening portion and a lower crimping portion with an arcuate plunger slide area therebetween; the crimping portion having an inward crimping lip; the plurality of jaws and the plunger being in an abutting relationship; the jaws being in an open position when the plunger is at the start position and in a closed position when the plunger is at the stop position; where, optionally, when the tool is in a reset mode, the rocker switch can be pressed to adjust the start position and the value of "x" counts"; and, where, when the tool is in a crimp mode, the rocker switch can be pressed to adjust the stop position and the value of "y" counts. As an alternative to a rocker switch, two individual adjustment switches can be employed as up and down buttons.

Also, the plunger may have a no return position with a value of "z" counts, the no return position being intermediate of or between the start position and the stop position; and, where, upon activation of the trigger switch with the tool in the crimp mode, after the plunger has moved a value of "z-x" counts, the activation of the trigger switch becomes unnecessary for the controller to move the plunger an additional "y-z" to the stop position, unless the stall condition is detected, and to return the piston to the start position.

The present invention employs a different plunger and different jaws with the same housing, motor, speed reduction system, and control system to provide a powered decapping tool. With the instant jaws and plunger, the tool, with the jaws open, is placed over a capped vial or bottle. When the tool is activated, the motor, through the speed reduction system, moves the plunger downward, thereby closing the jaws. The plunger continues downward to force the vial or bottle downward and thereby removing the cap therefrom. Alternative jaws can be utilized. A first type of jaws is sized so that, when closed, the jaws will have an opening diameter of just greater than the diameter of the bottle or vial to be decapped. As the plunger moves down to engage the top of the cap, the jaws will engage the cap toward the cap underside where the cap is crimped underneath the bottle or vial opening lip. The alternative second type of jaws contains a toothed portion so that it engages the sides of the cap as the jaws are closed by the downward movement of the plunger.

The decapper of the present invention comprises a housing including a motor therein, the motor including a pulse disk on a motor powered shaft; a plunger movable by the motor between a start position, an intermediate position, and a stop position; a plurality of jaws extending from the housing, each of the plurality of jaws having an upper opening portion and a lower decapping portion with an arcuate plunger slide area therebetween; the decapping portion having a cap retainer; the plurality of jaws and the plunger being in an abutting relationship to pivot the jaws to an open position when the plunger is at the start position, to pivot the jaws to a closed position when the plunger is at the intermediate position and to retain the jaws in the closed position while the plunger moves to the stop position; and, a pulse sensor, where the motor powered shaft will rotate until the pulse sensor has detected a selected number of pulses from the pulse disk to move the piston from the start to the stop position, the selected number of pulses being adjustable. The cap retainer of each of the plurality of jaws comprises a cap engaging lip or a cap side engaging tooth.

BRIEF DESCRIPTION OF THE DRAWINGS

A better understanding of the present invention will be had upon reference to the following description in conjunction with the accompanying drawings, wherein.

DETAILED DESCRIPTION OF THE PREFERRED EMBODIMENT

Figure 1:
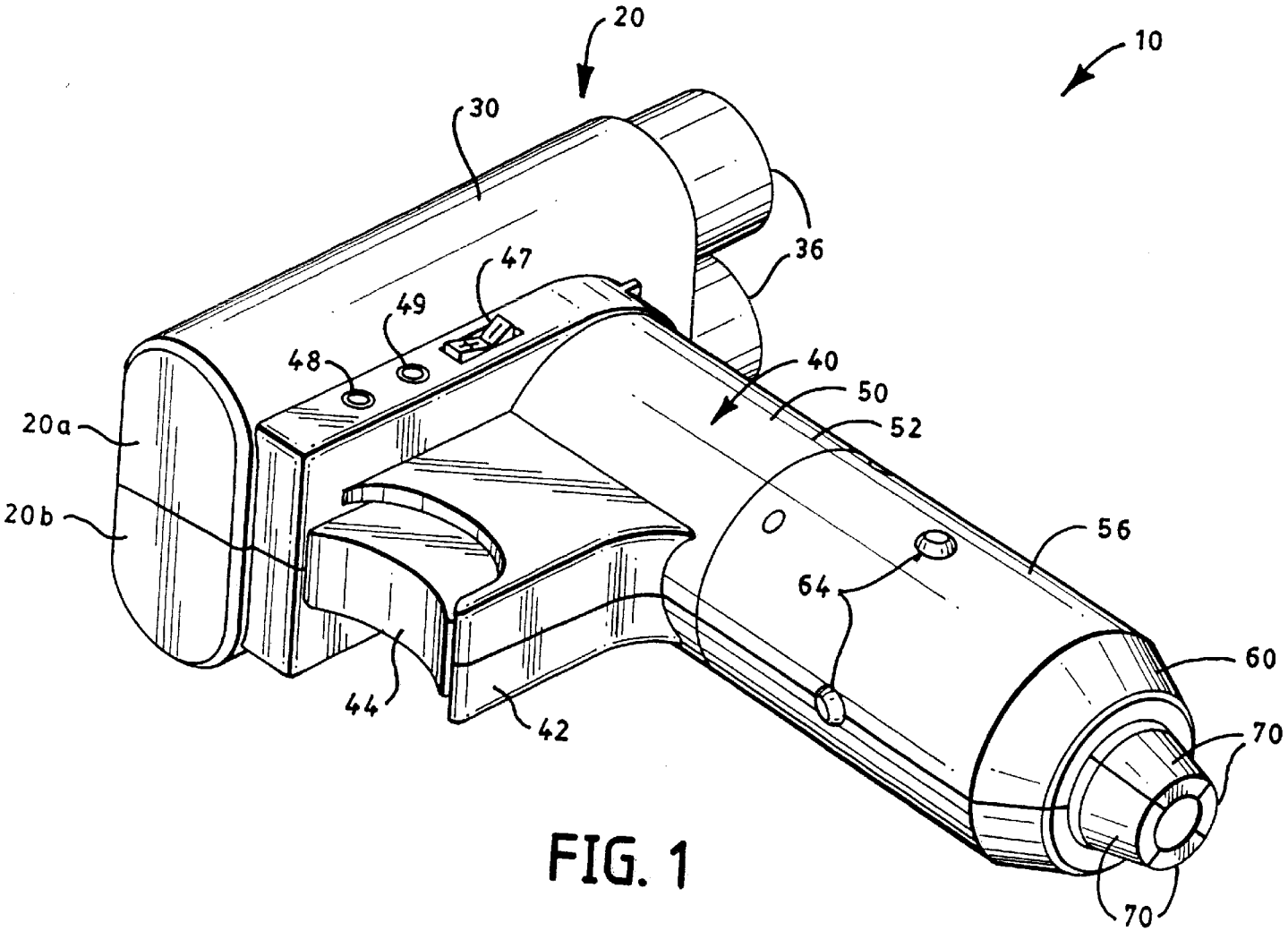
FIG. 1 Shows a first perspective view of the tool of the invention of the parent application.

FIGS. 1–12 teach the powered crimping tool 10 of the parent application, including the components and the electronics and operation. FIGS. 13–17 teach the powered decapper of the instant invention. The powered decapper has a different plunger and different jaws from the powered crimping tool. However, the remaining components and the electronics and operation of the decapper are as in the powered crimping tool.

With reference to FIGS. 1–9, the powered crimping tool 10 of the invention of the parent application is shown having a housing 20; a motor 90 which drives a plunger lead screw 110, through a speed or gear reduction system 95, the plunger lead screw 110 interfacing a plunger 130; four jaws 70 circumscribing plunger 130 and retained by circular spring 86. Tool 10 also contains electronics which permit the plunger 130 starting point to be adjusted and also permit the crimping cycle to be adjusted.

Figure 2:
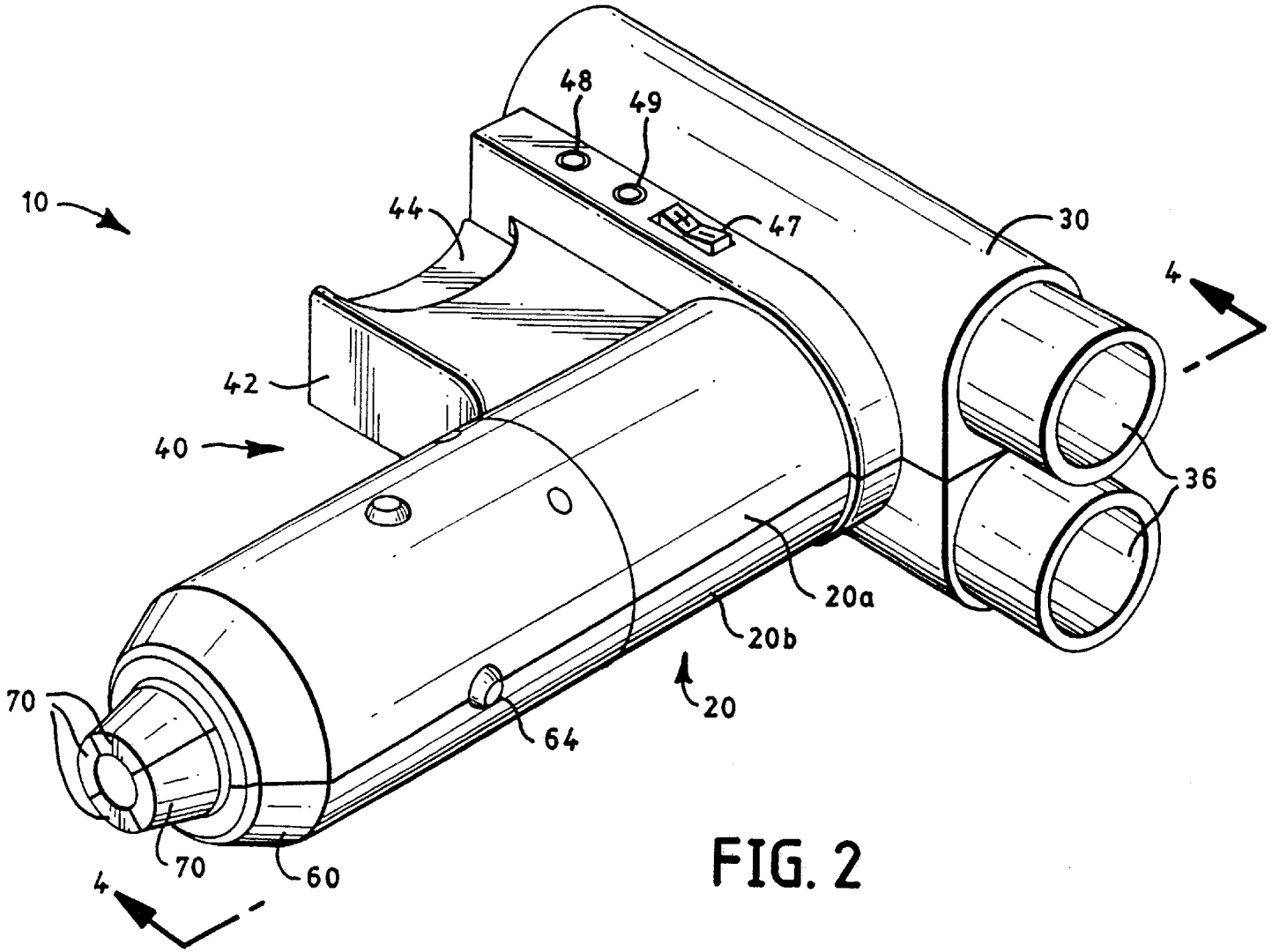
FIG. 2 shows a second perspective view of the tool of FIG. 1, the tool being rotated about 90° clockwise from the view of FIG. 1.

FIGS. 1 and 2 show the tool 10 having a split housing 20 having parts 20*a* and 20*b*. Housing 20 comprises an upper housing portion 30 and a lower housing portion 40. Lower housing portion 40 is the "grip" portion and will be held in a vertical orientation by a user when using the crimper. From portion 30 to jaws 70, portion 40 contains a trigger portion 42 and a vertically elongated chamber portion 50 adjacent portion 30. Adjacent chamber portion 50 is a middle plunger/gear receiving portion 56. Finally, there is a lower jaw receiving portion 60.

Figure 3:
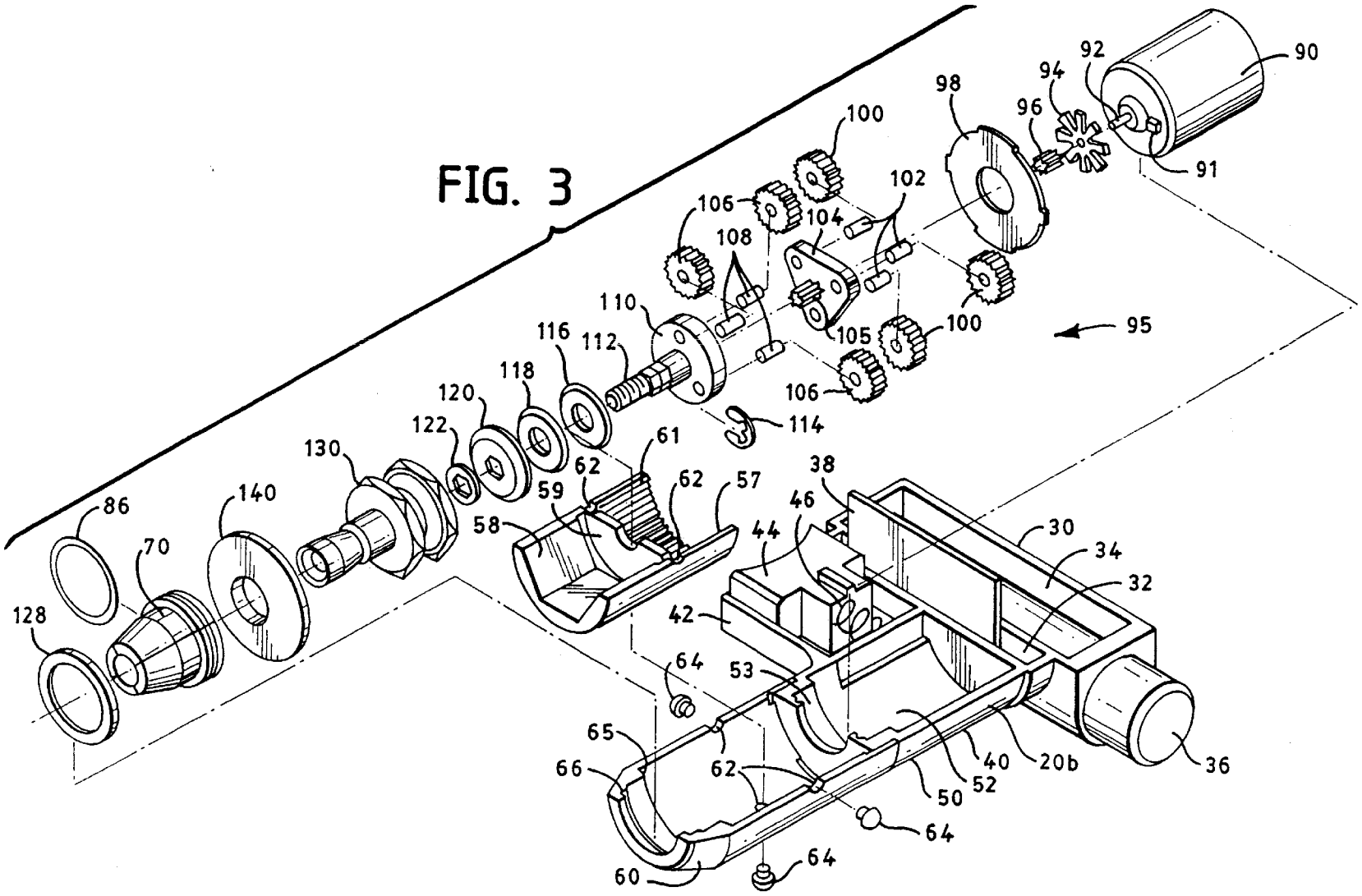
FIG. 3 shows an exploded view of the tool of FIGS. 1 and 2 with a portion of the housing and insert removed to show how the housing receives the various components.

With reference to FIGS. 1–3, upper housing portion 30 includes a horizontal elongated chamber 32 which contains circuit board 38. The operation of the electronics is explained later with reference to FIG. 10. However, the circuit board 38 is operationally connected to the power source, shown as a pair of 3.6 volt batteries 36, motor 90, pulse sensor or encoder 91, trigger 44, rocker switch 47 or alternative two adjustment switches, and LED 48. One or more batteries can be used to power the tool 10 and are received in battery receiving channels 34. If multiple batteries are used, they can be in parallel to provided more crimps per charge or in series to provide more power. Naturally, they will be matched to the motor requirements. As shown, a pair of batteries 36 provide 3.6 volts DC. Also, external power sources can be used to power the tool 10. On the outside of chamber 32 are rocker switch 47 or the alternative two adjustment switches and LED 48, the operation of which is explained with the description of the electronics with FIG. 10.

Trigger portion 42 includes a trigger 44 and a trigger spring 46. The trigger 44 is used to activate the crimping cycle and the spring 46 is used to deactivate the trigger 44. Any comparable activation means can be employed in place of the trigger system. For example, a simple push button could be used which makes a simple contact when pressed to activate the crimp cycle. This push button could be anywhere on housing 20 and would replace the entire trigger portion 42. So, instead of holding a trigger grip, the user would grip the cylindrical lower housing 40. For ergonomic design, the external shape of lower housing portion 40 could altered from cylindrical without operational effect.

Figure 4:
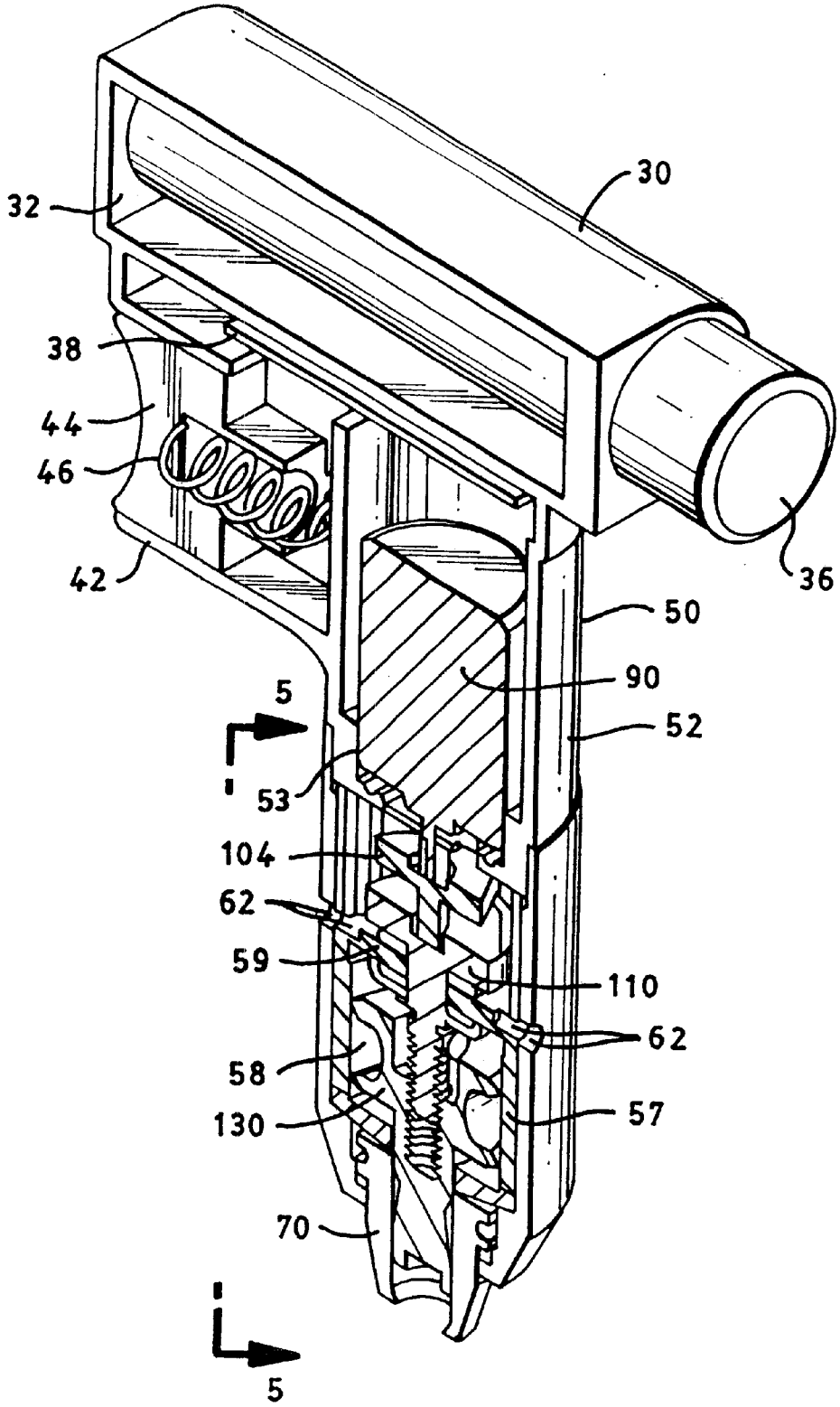
FIG. 4 shows a cross-sectional view of the tool of FIGS. 1 and 2 along the lines 4—4 of FIG. 2.
Figure 5:
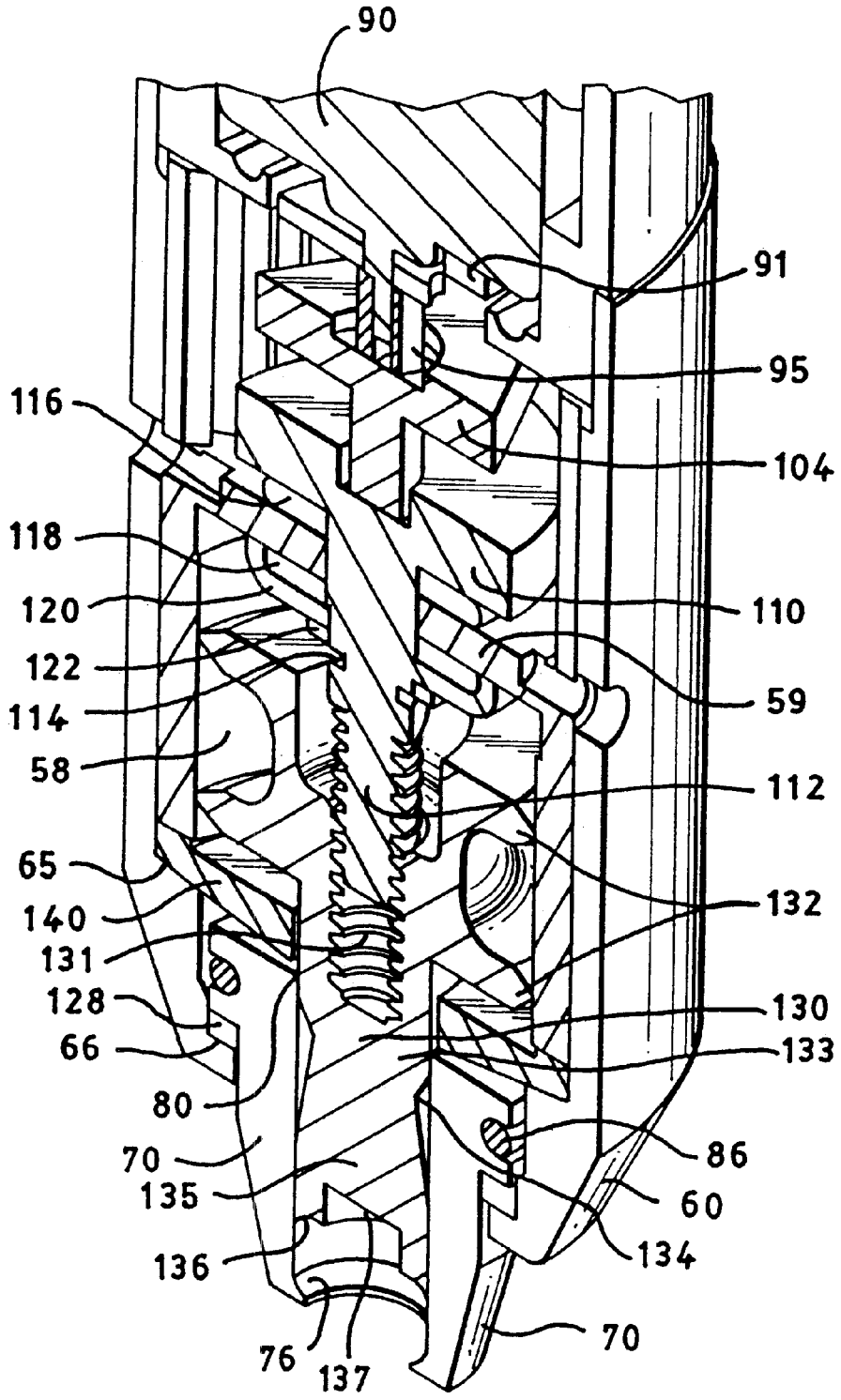
FIG. 5 shows an enlarged lower portion of the cross sectional view of FIG. 4 along the lines 5—5 of FIG. 4.
Figure 6:
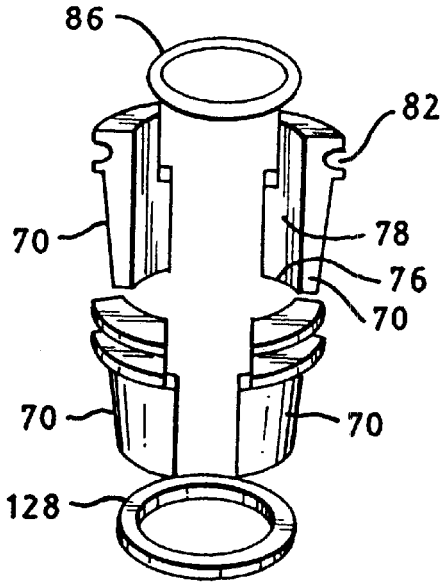
FIG. 6 shows an exploded perspective view of the jaws, circular spring, and steel bushing of the tool of the invention of the parent application.

With particular reference to FIGS. 3–5, the internal connectivity of the components is described. Chamber 50 contains an internal upper motor receiving portion 52 with a motor seat 53 at its lower portion. FIGS. 4 and 5 show how motor 90 is received within portion 52 and seat 53. Motor 90 is a typical DC 24 pole motor found in battery operated power tools, such as a Black & Decker model VP720 powered screwdriver. Without load, the motor powered shaft 92 rotates at about 5760 rpm. Attached to shaft 92 are a pulse disk 94 and a shaft gear 96. Pulse disk 94 provides for 8 pulses for every 360° rotation of shaft 92. Disk 94's cooperation with pulse sensor 91 and the tool's electronics are explained later.

A wear plate 98 is received on the lower side of motor seat 53 in middle portion 56. Adjacent the wear plate 98 is a unitary injection molded insert 57, a portion of which is shown in FIG. 3. Insert 57 and chamber 50 contain a plurality of aligned bores 62 therein which receive screws or bolts 64 therein to attach insert 57 in its desired location within chamber 50. Insert 57 contains a hex plunger channel 58 on its lower end and a gear channel 61 on its upper end, with a retaining member 59 with an opening therethrough in between 58/61. Gear channel 61 receives the speed or gear reduction system 95 therein.

Speed or gear reduction system 95 contains a pair of 8 to 1 speed reduction assemblies which first reduce the motor revolutions from approximately 5760 rpm to approximately 720 rpm and then to approximately 90 rpm. Three first gears 100 are received on shafts 102 attached to the upper side of a rotor 104. Motor shaft gear 96 is received within and engages the three first gears 100. The interior circumference of gear channel 61 is channeled to match the gearing of gears 100. With shaft gear 96 rotating at 5760 rpm, gears 100 rotate around shafts 102 and translate within gear channel 61 thereby causing the rotor 104 and gear shaft 105 on the lower side of rotor 104 to rotate at 720 rpm.

Three second gears 106 are received on shafts 108 attached to the upper side of plunger lead screw 110. Rotor shaft gear 105 is received within and engages the three second gears 106. With gear shaft 105 rotating at 720 rpm, gears 106 rotate around shafts 108 and translate within gear channel 61 thereby causing the plunger lead screw and the plunger threaded drive shaft 112 extending downward therefrom to rotate at 90 rpm. This results in a 64 to 1 reduction of motor 90 rotational speed in two 8 to 1 reduction stages. Similar speed reduction systems in more or less stages can be employed to achieve the desired rotational speed of the plunger lead screw 110. Also, under load, the rotational speeds will generally be less.

The plunger threaded drive shaft 112 receives an upper thrust bearing 116 thereover and then the shaft 112 is received through the opening in the insert 57 retaining member 59, extending into the hex plunger channel 58. On the under side of the member 59, shaft 112 sequentially receives a lower thrust bearing 118, a bearing housing 120, a retaining washer 122 and a retaining clip 114. The thrust bearings 116 and 118 help to minimize the torque requirements, the bottom thrust bearing 118 being leaded when the plunger 130 is moving downward and the upper thrust bearing 116 being loaded when the plunger 130 is moving upward.

Threaded drive shaft 112 is threadably received within plunger 130's threaded drive channel 131. Plunger hex guide member 132 and hex plunger channel 58 cooperate to prevent rotation of the plunger 130, but permit movement toward or away from the member 59. It is the rotation of plunger lead screw 110's threaded drive shaft-112 within plunger drive channel 131 and the cooperation of hex channel 58 and plunger hex guide member 132 which cause the circular rotation of motor 90's shaft 92 to be translated into a vertical movement of the plunger 130.

At the lower end of chamber 50 is a stop washer ridge 65 which has a stop washer 140 adjacent it's upper side. The lower side of stop washer 140 starts the lower jaw receiving portion 60 of the lower housing portion 40. At the lower portion of portion 60 is a steel bushing ridge 66 which has a steel bushing 128 adjacent it's upper side. Between stop washer 140 and steel bushing 128 are a plurality of crimping jaws 70. The upper part of jaws 70 abut stop washer 140. The lower part of jaws 70 extend downward through an opening in steel bushing 128. For the preferred embodiment, four jaws 70 are used, although other numbers can be employed within the scope of the invention. The lower portion of the plunger 130 is received within the central circular opening through the jaws 70.

Figure 7:
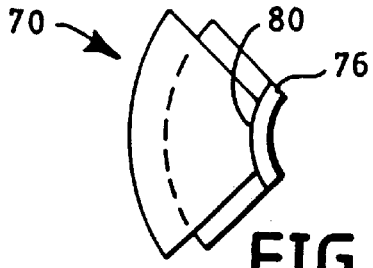
FIG. 7 shows a top view of the jaw of FIG. 8 along the lines 7—7.
Figure 8:
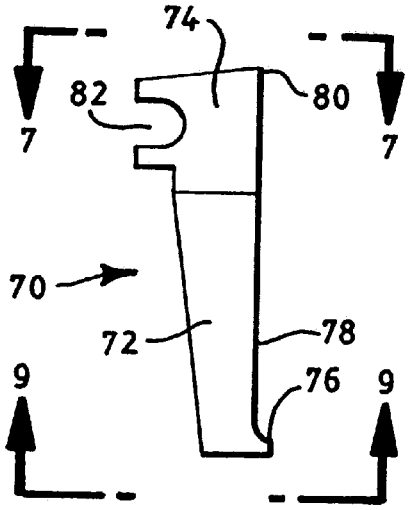
FIG. 8 shows a side view of one of the four jaws of the tool of the invention of the parent application.
Figure 9:
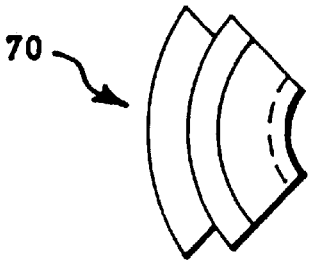
FIG. 9 shows a bottom view of the jaw of FIG. 8 along the lines 9—9.

FIGS. 3–6 show that four jaws 70 are retained on plunger 130 by circular spring 86. Other means, such as an elastic or rubber band can be employed. FIGS. 7–9 show one of the jaws 70. Jaw 70 includes a lower crimping portion 72 and an upper opening portion 74. Portion 72 includes a curved crimping lip 76. The inside curved surface of jaw 70 has a plunger slide area 78 shaped such that when the four jaws 70 are placed together the areas 78 are generally cylindrical shaped with a diameter which approximates that of plunger 130. An engagement point for opening 80 permits jaws 70 to open when received by plunger 130's jaw opening portion 134. A generally horizontal groove 82 is provided to receive circular spring 86.

With particular reference to FIG. 5, the plunger 130 also includes a jaw crimping slide portion 133, the jaw opening portion 134, a cap engaging head 135, a curved surface 136 for centering the cap, and a flat surface 137 to engage the cap top. It is seen that the jaw opening portion 134 has an hour glass shape. In FIG. 5, the jaws 70 are closed, as the plunger 130 has moved downward beyond the cap open position. It can be seen that, if the plunger 130 was moved upward, the jaw opening engagement point 80 will align with the start of the inward slope of jaw opening portion 134. As the plunger 130 continues to move upward, the circular spring 86 in groove 82 causes point 80 to follow the inward slope, thereby causing the jaws 70 to spread apart at the bottom or open so that they can be placed over a bottle or vial for the crimping of a cap thereon. The jaws 70 would be the most open when point 80 is at the smallest diameter part of the hour glass of jaw opening portion 134. As is explained hereinafter, this would generally be the starting point for the crimping cycle. However, if working in confined places, the tool user may not want the jaws to open to this widest opening. Therefore, the starting point can be adjusted by movement of the piston downward to slightly close the jaws 70. For example, the hour glass portion. of portion 134 toward portion 133 slopes inward at about 20° from vertical. The cooperation of the plunger 130 and the curved crimping lip 76 cause a cap to be crimped onto a vial or bottle. As explained hereinafter, this cooperation can be adjusted by controlling the stop point of the downward movement of the plunger 130.

Figure 10:
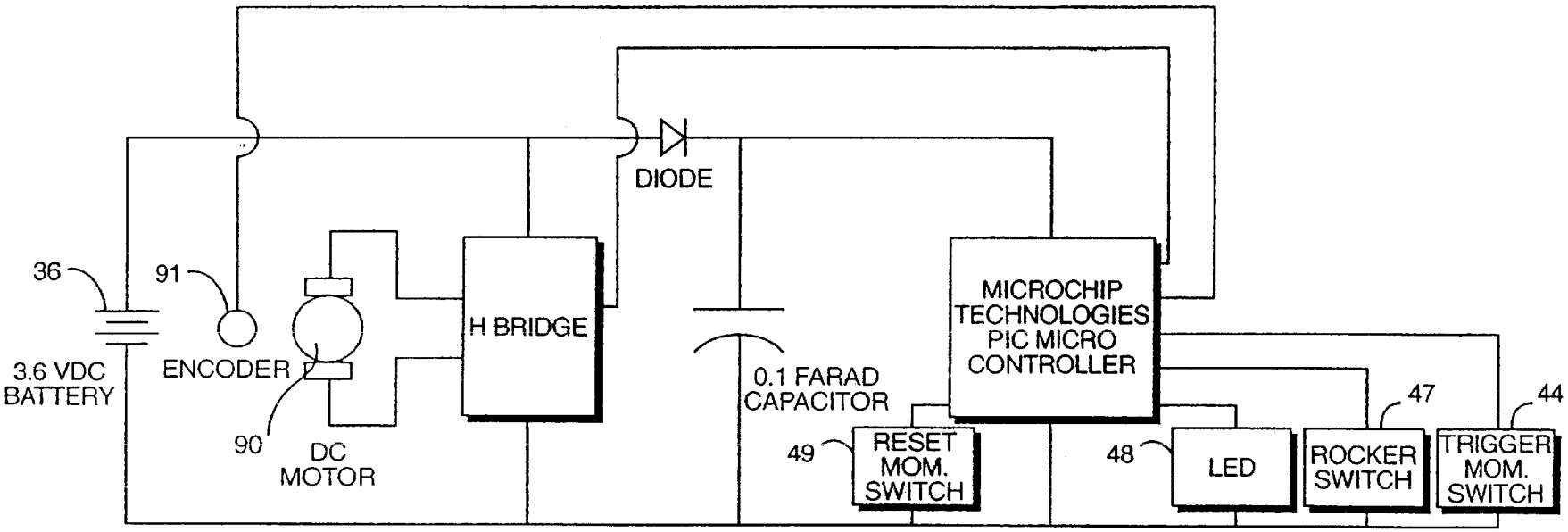
FIG. 10 is a block diagram of the electronic controls of the invention of the parent application.
Figure 11:
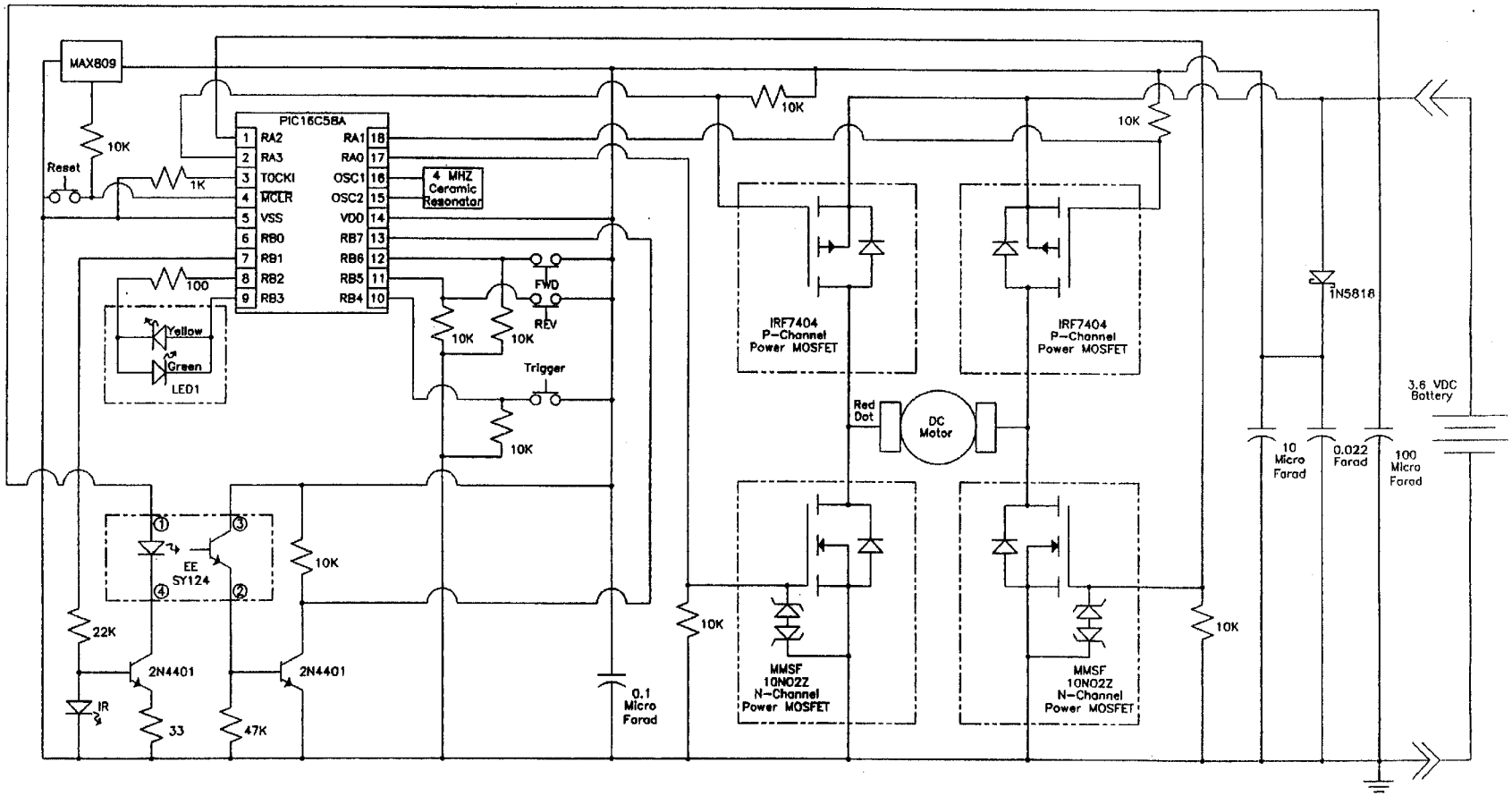
FIG. 11 schematically shows the electronic controls of the invention of the parent application.
Figure 12:
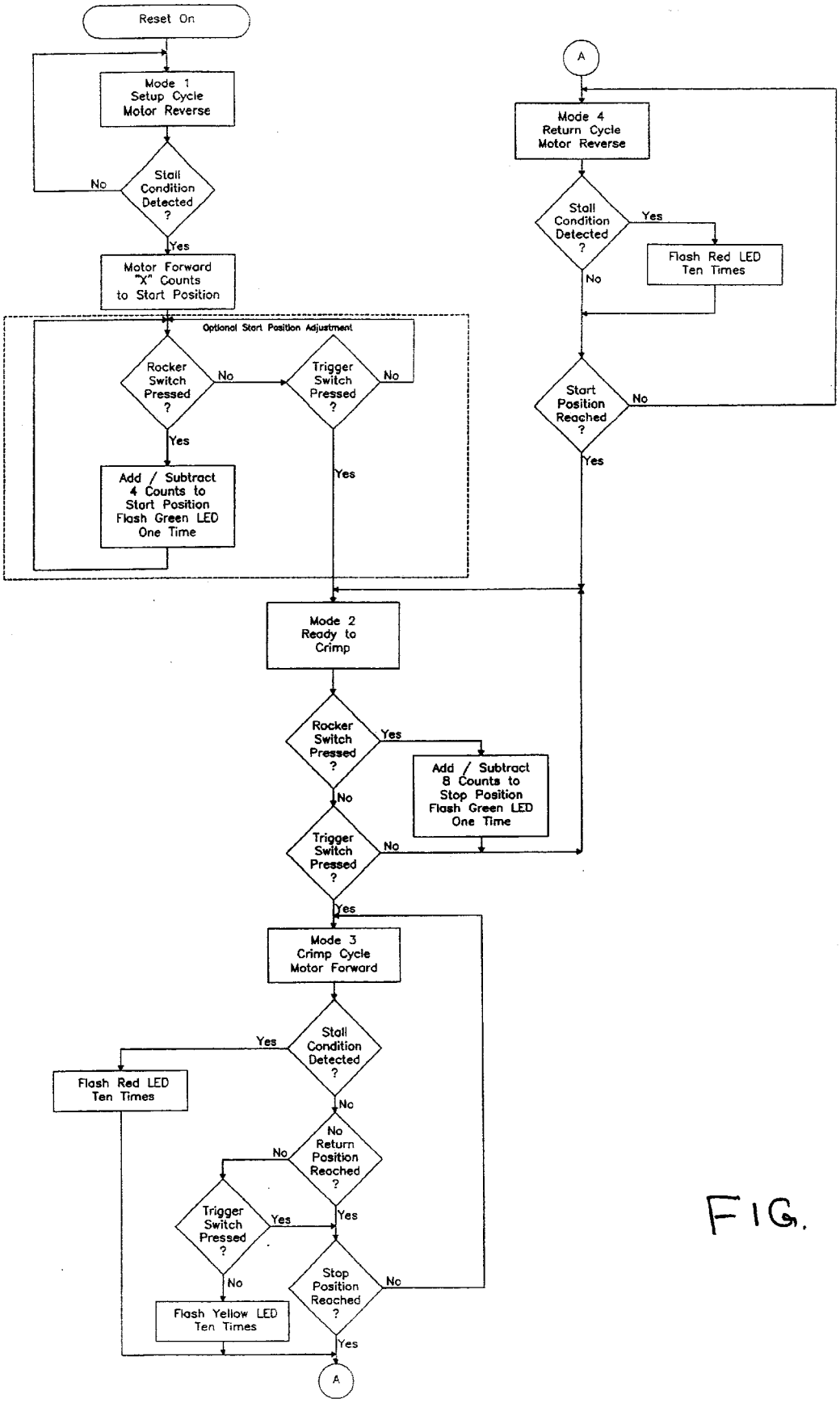
FIG. 12 is a computer flowchart for the powered crimper setup or adjustment and operation.

FIGS. 10 and 11 show, in block diagram and schematic, the electronic controls for the tool 10, many of which are mounted on circuit board 38 or connected thereto. FIG. 12 shows a flowchart of how the computer program controls the setup and operation of the powered crimper. Battery or batteries 36 are shown providing power to motor 90 upon activation. When the battery or batteries have an insufficient charge remaining, the three-color LED 48 will be constantly illuminated in red. Pulse sensor 91 detects rotational movement of the motor 90 shaft. With motor 90 operating at 5760 rpm and the pulse disk identifying 8 pulses per motor shaft revolution, the starting and stopping points of the crimp cycle can be very accurately set, incrementally adjusted, and stored in memory. All of this is controlled by a Microchip Technologies PIC Micro Controller, model number PIC 16C58.

The tool 10 has a start-up mode and a crimp mode, which operate as shown by the flowchart of FIG. 12. The start-up mode is initiated by engaging a reset switch 49 or upon insertion of a charged battery into battery receiving channel 34 if the 0.1 Farad memory backup capacitor has discharged because of an extensive period without a connected or charged battery. First, the motor 90 reverses, moving the plunger 130 upward, until a stall condition is detected. A stall condition is detected when the motor rpm decreases and the time between pulses from disk 94 is about 10 times the normal operating time. Then, the motor 90 reverses direction and moves the plunger downward to a pre-set START position. In general, the motor will rotate until the pulse sensor has detected a pre-set number of pulses. Typically, this will move the plunger downward so that the jaws 70 are at their most open position, that is, where 80 is at the narrowest diameter portion of hour glass 134. The START or jaw open position can optionally be adjusted by pressing the + or − on the rocker switch 47 or respective up or down alternative adjustment switches to raise or lower the plunger. Each time the rocker switch 47 or one of the two alternative adjustment switches is pressed, the motor 90 rotates for a pre-set number of pulse counts and the LED will flash green one time. This can be any desired number, but is preferably 4 counts. If start-up mode optional start position adjustment is employed, then trigger 44 is pressed to disengage the start-up mode. Otherwise, the crimper automatically exits the start-up mode after reaching the START position.

The tool 10 is now configured for the preset crimp cycle. That is, upon activation of the crimp cycle by pressing the trigger 44, the motor 90 will rotate until the pulse sensor has detected a pre-set number of pulses, thereby moving the piston from the START position to the STOP position. Then, the motor 90 will reverse and the piston will be returned to the START position. With the present embodiment, the piston moves through about 0.250 vertical inch between the START and STOP. The number of threads per inch of plunger drive shaft 112 and plunger threaded drive channel 131 affect how many pulses between START and STOP positions.

It is desirable that the operator not have to engage the trigger 44 for the entire crimp cycle. While it could be set so that a simple press and release of the trigger would cause the tool to go through a complete crimp cycle, a safety factor is desired. Therefore, the trigger 44 must be pressed and held until the motor 90 rotates for sensing of a pre-set number of pulses, for example, 640 pulses. If the pre-set number of pulses is not reached, the LED will flash yellow 10 times after the motor has reversed. Once this rotation has occurred, the "No RETURN" position has been reached and the crimp cycle will be completed even if the trigger is released, unless a stall condition is sensed. If a stall condition is sensed, by a time period between pulses which is about 10 times than the normal time period between pulses, before the plunger reaches the STOP position, the motor will automatically reverse and return the plunger to the START position and the LED 48 will flash red 10 times in 5 seconds or until the start of the next crimp cycle, if less than 5 seconds, to notify the user that the crimp cycle was not completed.

In the crimp mode, the rocker switch 47 or two alternative adjustment switches can be used to adjust the STOP position. By using the + or − on the rocker switch 47 or the up or down alternative adjustment switches, the plunger STOP limit can be adjusted downward or upward. Each time the rocker switch 47 or one of the two adjustment switches is pressed, the motor 90 rotates for a pre-set number of pulse counts. This can be any desired number, but is preferably 8 counts and the LED will flash green one time. Therefore, if the tool 10 user sees that a bottle or vial has not had the cap adequately crimped thereon, the rocker switch 47 or alternative down adjustment switch can be adjusted so that the plunger 130 will move further downward for the STOP position and that vial or bottle re-crimped. If the user sees that a vial or bottle is having the cap crimped on too tightly, the rocker switch 47 or alternative up adjustment switch can be adjusted so that the plunger will stop further upward for the STOP position so that future vials or bottles will not have the cap crimped on as tightly.

While the above-described means for electronically adjusting the stop position is the inventors' preferred embodiment, alternatives can be employed. For example, instead of using a controller which counts pulses to control the various positions, a limit switch could be employed. The motor would move the plunger one direction until a desired limit was reached and then the motor would be reversed and the plunger moved in the opposite direction. The limit switch limit could be altered to adjust the plunger downward limit.

The present decapper invention replaces the plunger 130 of the crimping tool 10 with a plunger 230 for the decapping tool and replaces the four jaws 70 of the crimping tool 10 with four jaws 170, or alternatively 270, as shown in FIGS. 13–18.

Figure 13:
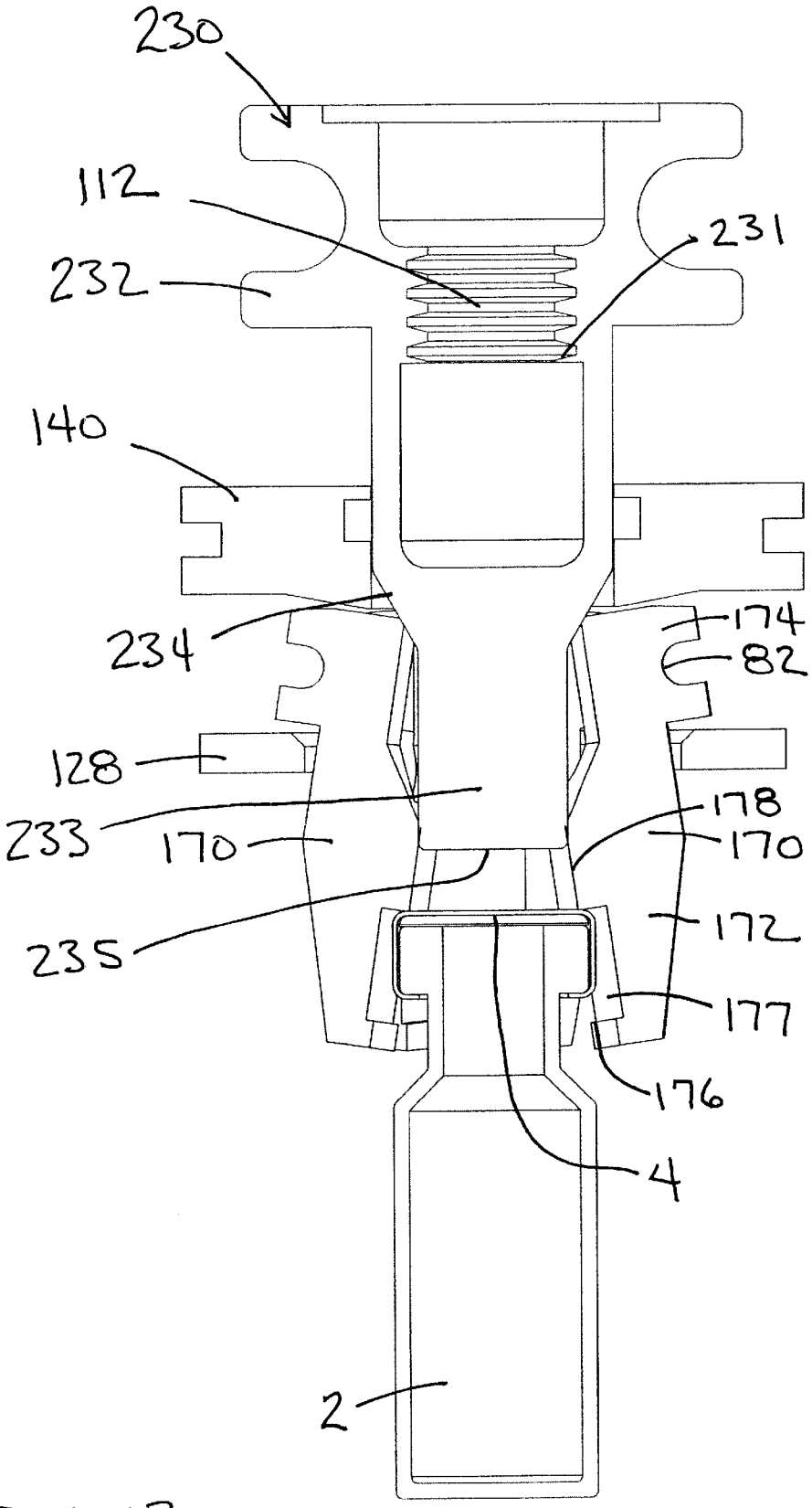
FIG. 13 demonstrates the decapper of the present invention, showing the plunger and two of the four jaws in the open position.
Figure 14:
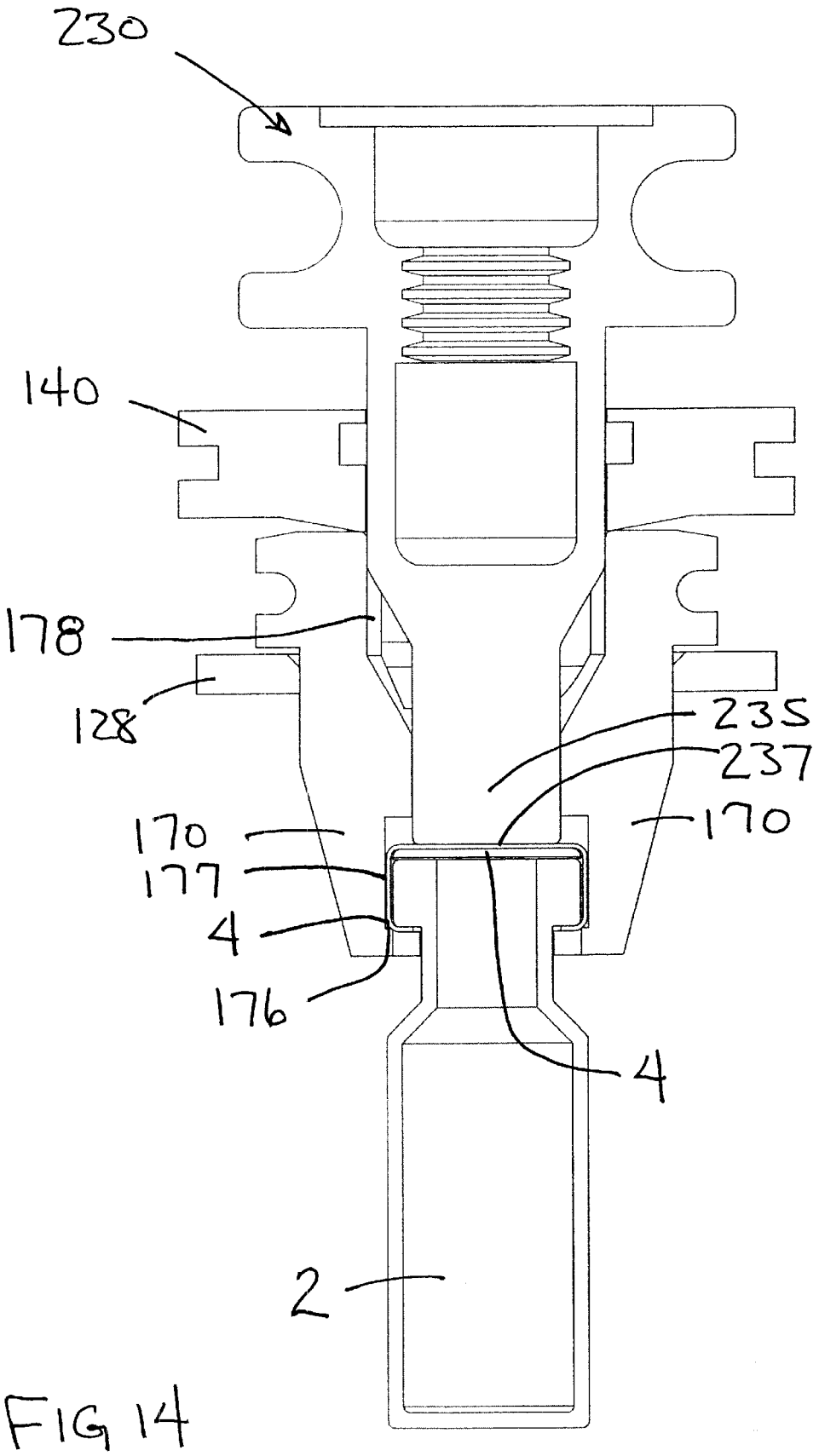
FIG. 14 demonstrates the decapper of the present invention, showing the plunger and two of the four jaws in the closed position ready to begin decapping.
Figure 15:
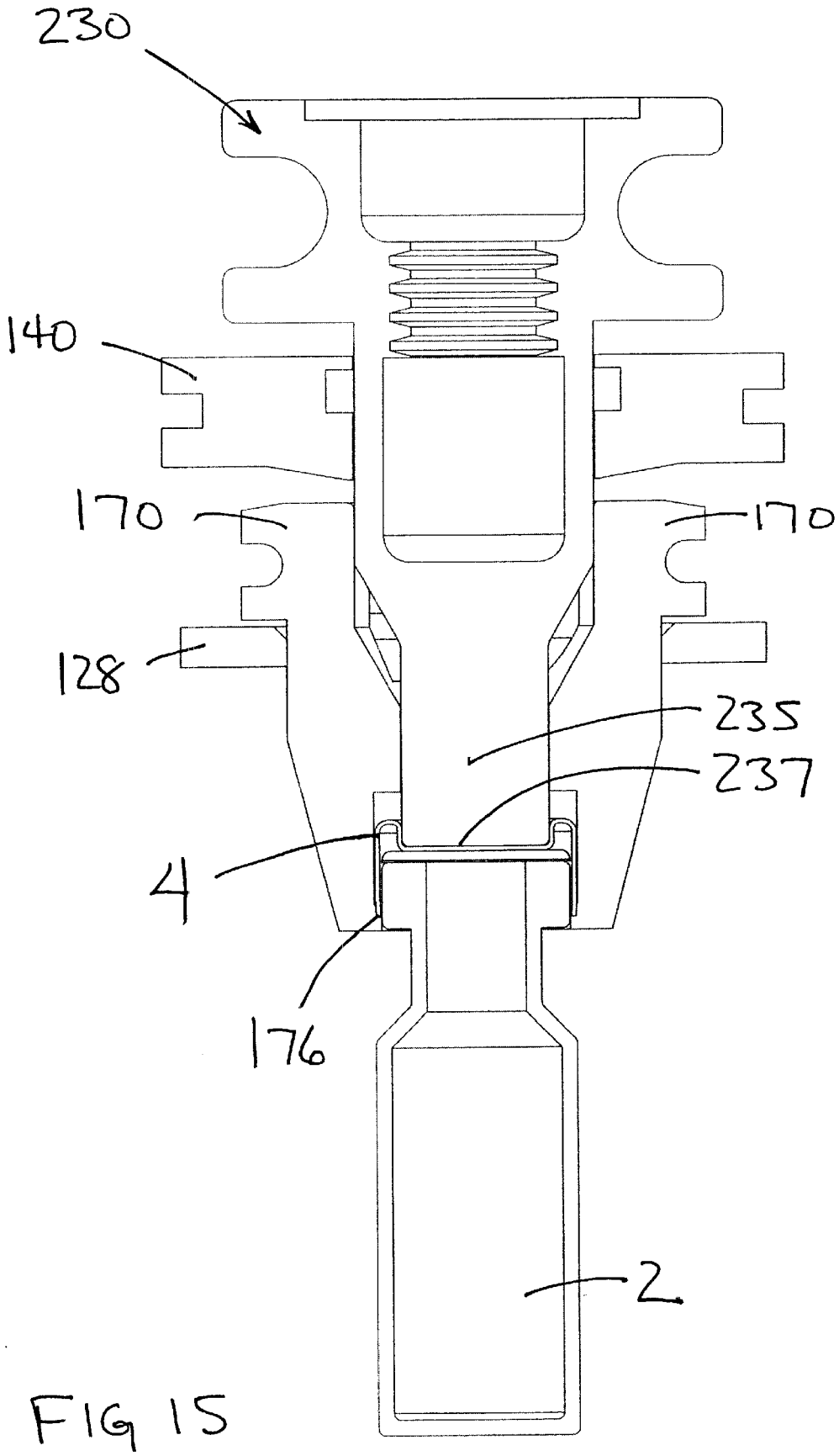
FIG. 15 demonstrates the decapper of the present invention, showing the plunger and two of the four jaws with the vial cap being partially removed.

In FIGS. 13–15, the decapping operation is demonstrated. In these figures, only two of the four jaws 170 are shown so that the movement of the plunger 230 to close the jaws 170 around the vial 2 and remove cap 4 can be clearly seen. Four jaws 170 (FIG. 16) or four alternative jaws 270 (FIG. 17) can be employed with plunger 230, the four jaws 170 or 270 having the same relative positions as jaws 70 described earlier.

Figure 16:
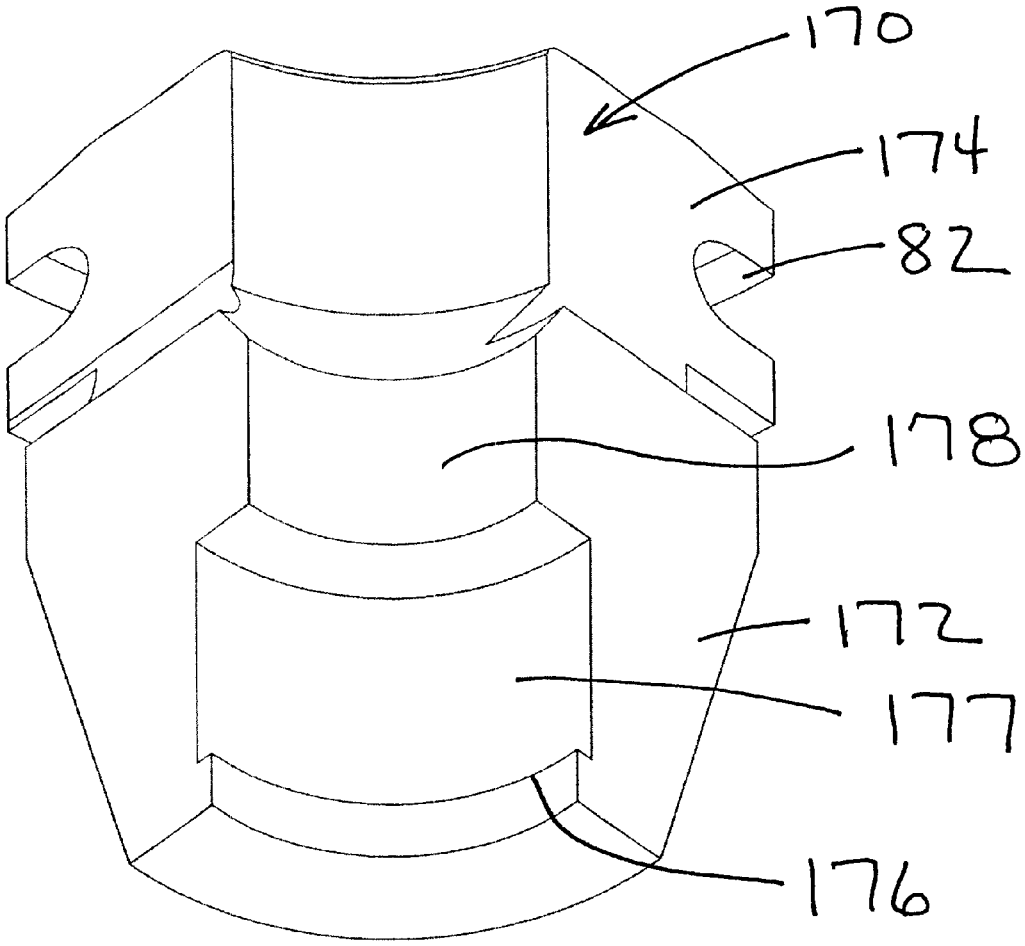
FIG. 16 shows one of the four jaws used with the decapper of FIGS. 13–15.

One of jaws 170 is seen in FIG. 16. Jaw 170 includes a lower decapping portion 172 and an upper opening portion 174. Lower decapping portion 172 includes a cap engaging lip 176 and a cap receiving area 177. As with jaws 70, upper opening portion 174 includes a groove 82 to receive circular spring 86. The plunger slide area is identified by the number 178.

FIG. 13 demonstrates the relative position of plunger 230 and jaws 170 in the open decapper position. This equates to the start position of the crimper 10 previously described. Plunger 230 includes plunger drive channel 231 to receive drive shaft 112, plunger hex guide member 232, jaw decapping slide portion 233, jaw closing portion 234, and the cap engaging head 235 which includes flat surface 237 to engage the cap top. In FIG. 13, the jaws 170 are in the open decapper position, a cap 4 on vial 2 being received within the cap receiving area 177 of jaws 170. As was mentioned earlier, FIG. 13, as well as FIGS. 14–15, only shows two of the four jaws 170 employed so that the decapping operation can be demonstrated. In actuality, as with jaws 70, the four jaws 170 circularly enclose cap 4.

In FIG. 14, plunger 230 has moved downward to engage the cap 4. This is an intermediate position between the start and stop position. As with powered crimper 10, this has been caused by rotation of motor 90 through speed reduction system 95 to rotate plunger threaded drive shaft 112 to move the plunger 230 downward as permitted by hex plunger channel 58 and plunger hex guide member 232. In FIG. 13, the narrow lower part of jaw closing portion 234 of plunger. 230 was at the upper end of jaws 170 upper opening portion 174, thereby permitting the jaws 170 to be open as permitted by circular spring 86 in groove 82. With the downward movement of plunger 230 in FIG. 14, the jaw closing portion 234 has moved into the plunger slide area 178 to close the jaws 170. The top of the vial 2 containing the cap 4 has a vial diameter and the cap crimped thereon has an outer cap diameter. With the jaws 170 closed, the cap receiving area 177 of the four jaws 170 has a diameter approximating the outer cap diameter, while the cap engaging lip portion 176 of the four jaws 170 has a diameter minimally greater than the vial diameter and less than the outer cap diameter. As seen in FIG. 14, surface 237 of cap engaging head 235 is engaging the top flat portion of cap 4 and cap engaging lips 176 of jaws 170 engage the bottom of the downward portion of the cap 4 where it is crimped under the top portion of the vial 2.

In FIG. 15, the plunger 230 has been moved further downward toward the stop position by the operation of motor 90 so that the cap 4 is being removed from vial 2. As can be seen, the diameter of the cap engaging lip portion 176 of the four jaws 170 permits the vial 2 top portion to move downward but prevents the cap 4 from so moving. Therefore, the continued downward movement of plunger 230 to the stop position will result in vial 2 being decapped. After the vial 2 is decapped, the plunger reverses to return to the position of FIG. 13 so that the jaws 170 are open and the cap 4 can be removed.

Figure 17:
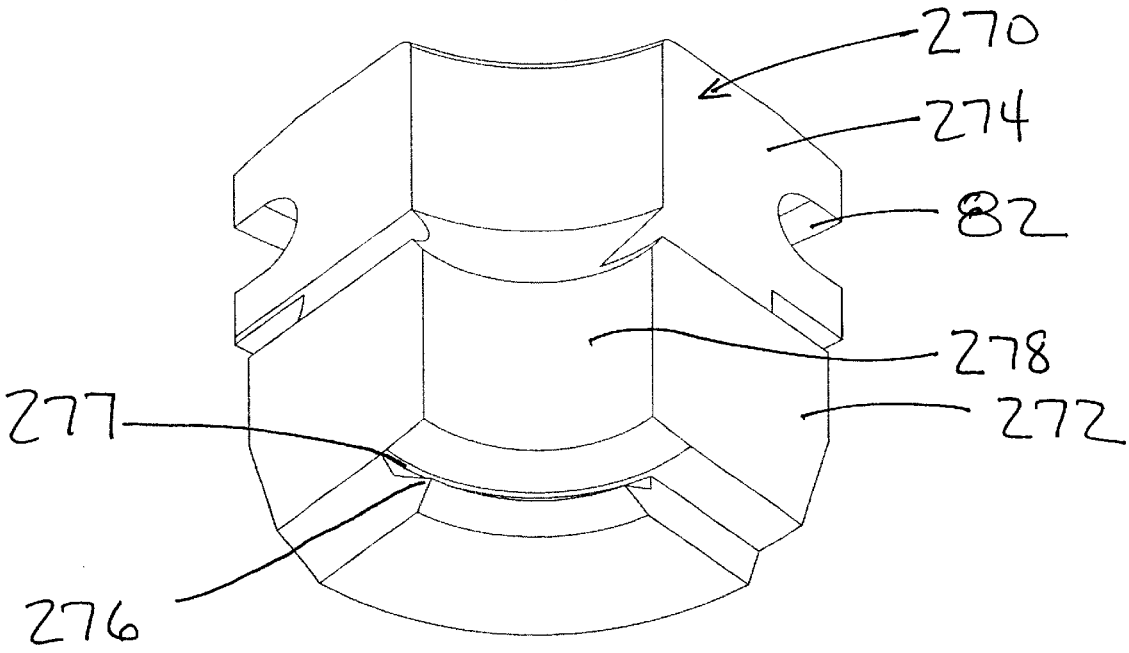
FIG. 17 shows one alternative jaw to that of FIG. 16 for alternative use with the decapper of the present invention; and, FIG. 18 shows the embodiment of FIG. 14 with the optional addition of at least one spiral retaining ring to help the jaws maintain a close fit to the vial as the decapper is operated.

FIG. 17 shows an alternative decapping jaw 270 to that of decapping jaw 170. As with jaws 70 and jaws 170, four identical jaws 270 will be employed. Each jaw 270 includes a lower decapping portion 272 and an upper opening portion 274. Lower decapping portion 272 includes a cap side engaging tooth 276 and a cap receiving area 277. As with jaws 70 and 170, upper opening portion 274 includes a groove 82 to receive circular spring 86. The plunger slide area is identified by the number 278. When using jaws 270 in the decapping operation, cap side engaging teeth 276 will grip into the side of cap 4 rather than lips 176 which engaged the cap 4 where the cap 4 was crimped under the vial 4 top portion. Both lips 176 and teeth 276 serve as a cap retainer when the vial 2 is being decapped. The decapping operation using jaws 270 is as with jaws 170. Plunger 230 is moved downward by operation of motor 90 to push the vial 2 downward while the cap 4 is retained by the jaws.

Figure 18:
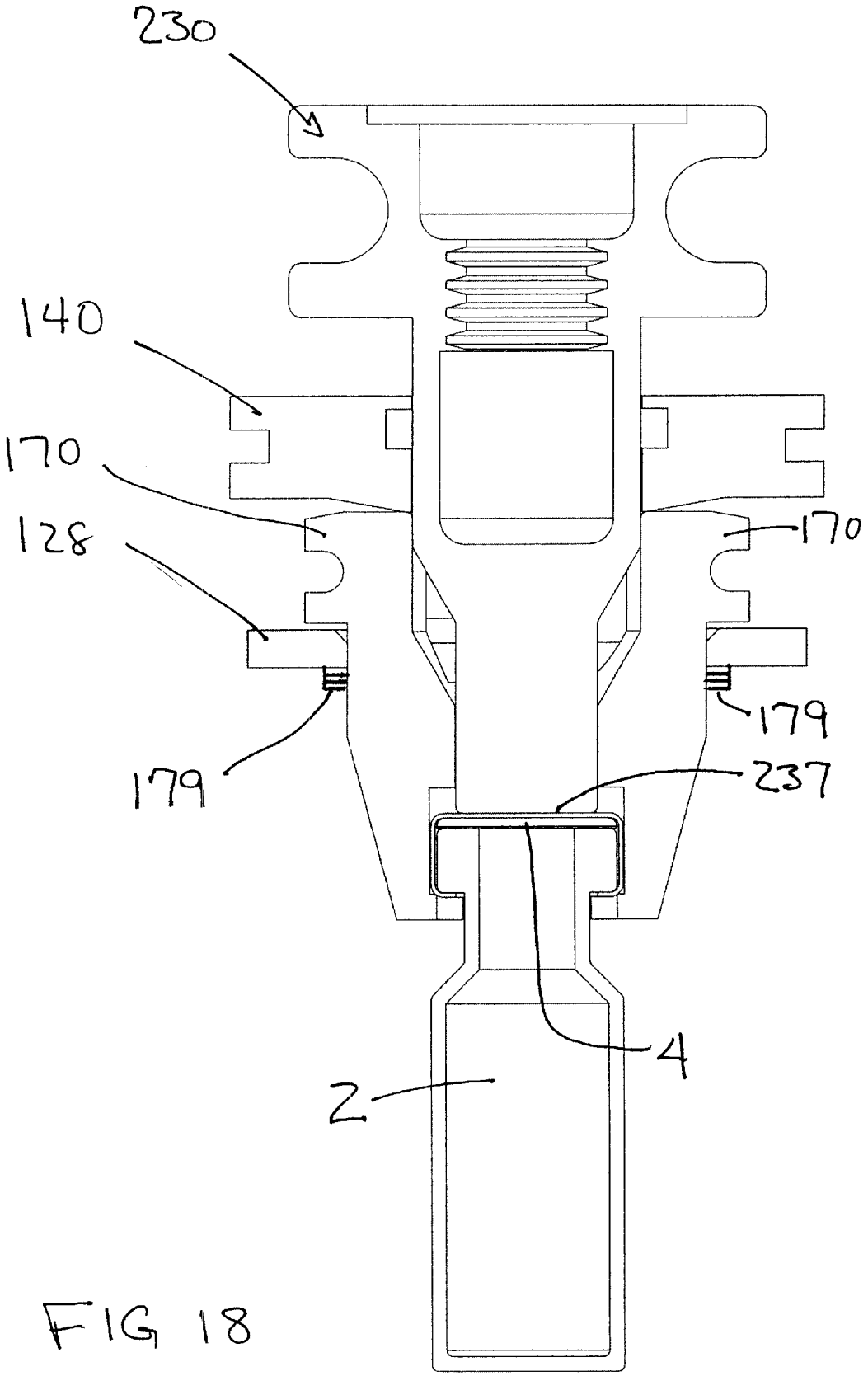

FIG. 18 adds an optional at least one spiral retaining 179 to the embodiment of FIG. 14 to help the jaws 170 maintain a close fit to the vial as the decapper is being operated to remove cap 4. This is of assistance due to varying manufacturing tolerances of vials 4. Three rings 179 are shown in FIG. 18 below steel bushing 128 and serve to urge the jaws 170 toward the closed position.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. A powered decapping tool, comprising:

a. a housing comprising a motor therein, said motor including a pulse disk on a motor powered shaft;

b. a plunger movable by said motor between a start position, an intermediate position , and a stop position;

c. a plurality of jaws extending from said housing, each of said plurality of jaws having an upper opening portion and a lower decapping portion with an arcuate plunger slide area therebetween; said lower decapping portion having a cap retainer; said plurality of jaws and said plunger being in an abutting relationship to pivot said jaws to an open position when said plunger is at said start position, to pivot said jaws to a closed position when said plunger is at said intermediate position and to retain said jaws in said closed position while said plunger moves to said stop position; and, d. a pulse sensor, where said motor powered shaft will rotate until said pulse sensor has detected a selected number of pulses from said pulse disk to move said piston from said start to said stop position, said selected number of pulses being adjustable.

2. The powered decapping tool of claim 1, further comprising: means for electronically adjusting said start position.

3. The powered decapping tool of claim 2, where said means for electronically adjusting said start position causes said motor powered shaft to rotate until said pulse sensor has detected a pre-set number of pulses from said pulse disk.

4. The powered decapping tool of claim 3, said motor powered shaft being connected to a speed reduction system, said speed reduction system being connected to a plunger threaded drive shaft; said plunger having a threaded drive channel receiving said plunger threaded drive shaft, said plunger having a hex guide member toward an upper end; said housing containing an insert having a hex plunger channel receiving said plunger hex guide member; where, when said motor is operated to cause said powered shaft to rotate in a first direction, said plunger threaded drive shaft rotates to cause said plunger to move in a decapping direction without rotation as permitted by a cooperation between said hex plunger channel and said plunger hex guide member; and where, when said motor is operated to cause said powered shaft to rotate in a second direction opposite said first direction, said plunger threaded drive shaft rotates to cause said plunger to move away from said decapping direction as permitted by a cooperation between said hex plunger channel and said plunger hex guide member.

5. The powered decapping tool of claim 4, further comprising: means for activating said motor.

6. The powered decapping tool of claim 5, where said activating means must be engaged for a pre-set interval during which said plunger moves from said start position to a no return position and where, thereafter said plunger will move on to said stop position and then to said start position irrespective of said condition of said activating means.

7. The powered decapping tool of claim 6, where said housing includes a lower housing portion which will be held by a tool operator and, when said tool is so held, said plurality of jaws extending from said housing extend in a vertically downward direction.

8. The powered decapping tool of claim 1, where said powered shaft is connected to a speed reduction system, said speed reduction system being connected to a plunger threaded drive shaft; said plunger having a threaded drive channel receiving said plunger threaded drive shaft, said plunger having a hex guide member toward an upper end; said housing containing an insert having a hex plunger channel receiving said plunger hex guide member; where, when said motor is operated to cause said powered shaft to rotate in a first direction, said plunger threaded drive shaft rotates to cause said plunger to move in a decapping direction as permitted by a cooperation between said hex plunger channel and said plunger hex guide member; and where, when said motor is operated to cause said powered shaft to rotate in a second direction opposite said first direction, said plunger threaded drive shaft rotates to cause said plunger to move away from said decapping direction as permitted by a cooperation between said hex plunger channel and said plunger hex guide member.

9. The powered decapping tool of claim 8, where said plunger threaded drive shaft is received by an upper thrust bearing and a lower thrust bearing, said thrust bearings reducing tool torque requirements.

10. The powered decapping tool of claim 1, where said motor is operable by activation of an internal direct current power source.

11. The powered decapping tool of claim 1, where said motor is operable by an external power source.

12. The powered decapping tool of claim 1, where said housing includes a lower housing portion which will be held by a tool operator and, when said tool is so held, said plurality of jaws extending from said housing extend in a vertically downward direction.

13. The powered decapping tool of claim 1, further comprising: means for activating said motor.

14. The powered decapping tool of claim 13, where said activating means must be engaged for a pre-set interval during which said plunger moves from said start position to a no return position and where, thereafter said plunger will move on to said stop position and then to said start position irrespective of said condition of said activating means.

15. The powered decapping tool of claim 1, where said cap retainer of each of said plurality of jaws comprises a cap engaging lip.

16. The powered decapping tool of claim 1, where said cap retainer of each of said plurality of jaws comprises a cap side engaging tooth.

17. A powered decapping tool, comprising: a housing containing a motor therein, said housing having a trigger switch, a rocker switch, and a reset switch;

said housing containing a circuit board having a controller operably connected thereto, said trigger switch, said rocker switch, and said reset switch being operably connected to said controller;

said motor includes a pulse disk on a motor powered shaft and where said tool includes a pulse sensor, said motor powered shaft being operably connected through a speed reduction system and a plunger lead screw to a plunger movable between a start position with a value of "x" counts, an intermediate position, and a stop position having a value of "y" counts;

where, by operation of said trigger switch and said motor thereby, said controller will cause said motor powered shaft to rotate until said pulse sensor has detected a first selected number of pulses with a value of "y-x" counts from said pulse disk to move said piston from said start to said stop position, unless a stall condition is detected, and when said first selected number of pulses has been detected or said stall condition is detected, said motor powered shaft will rotate to return said piston to said start position;

a plurality of jaws extending from said housing, each of said plurality of jaws having an upper opening portion and a lower decapping portion with an arcuate plunger slide area therebetween; said lower decapping portion having a cap retainer; said plurality of jaws and said plunger being in an abutting relationship to pivot said jaws to an open position when said plunger is at said start position, to pivot said jaws to a closed position when said plunger is at said intermediate position, and to retain said jaws in said closed position while said plunger moves to said stop position; and, where, when said tool is in a decap mode, said rocker switch can be pressed to adjust said stop position and said value of "y" counts.

18. The powered decapping tool of claim 17, where said plunger has a no return position with a value of "z" counts, said no return position being between said start position and said stop position; and, where, upon activation of said trigger switch with said tool in said decap mode, after said plunger has moved a value of "z-x" counts, said activation of said trigger switch becomes unnecessary for said controller to move said plunger an additional "y-z" to said stop position, unless said stall condition is detected, and to return said piston to said start position.

19. The powered decapping tool of claim 17, where said cap retainer of each of said plurality of jaws comprises a cap engaging lip.

20. The powered decapping tool of claim 17, where said cap retainer of each of said plurality of jaws comprises a cap side engaging tooth.

* * * * *